US009792888B1

(12) United States Patent
Allen

(10) Patent No.: US 9,792,888 B1
(45) Date of Patent: Oct. 17, 2017

(54) DRUM MOUNT

(71) Applicant: Joshua Allen, Ann Arbor, MI (US)

(72) Inventor: Joshua Allen, Ann Arbor, MI (US)

( * ) Notice: Subject to any disclaimer, the term of this patent is extended or adjusted under 35 U.S.C. 154(b) by 0 days.

(21) Appl. No.: 15/159,857

(22) Filed: May 20, 2016

(51) Int. Cl.
*G10D 13/02* (2006.01)

(52) U.S. Cl.
CPC ..... *G10D 13/026* (2013.01)

(58) Field of Classification Search
CPC ..... G10D 13/026; G10D 13/02; G10D 13/00; G10D 13/028; G10G 5/00; Y10T 29/49574; G10H 2230/275; G10H 2230/281
See application file for complete search history.

(56) References Cited

U.S. PATENT DOCUMENTS 4,519,289 A * 5/1985 Gauger ..... G10D 13/026 84/421

* cited by examiner

*Primary Examiner* — Kimberly Lockett
(74) *Attorney, Agent, or Firm* — Thomas P. Heed

(57) ABSTRACT

An adjustable drum mount composed of a fixed component and at least one mounting component, wherein the relative position of the mounting component with respect to the fixed component is adjustable. The fixed component is durably attached to the drum shell with fasteners. The fixed component has a planar, extending member, which connects with the mounting component(s). The planar, extending member has one end, attached continuously to the bulk of the fixed component, called the fixed end. The planar, extending member has another end, disposed distal to the fixed end, called the free end, which can vibrate. The mounting components can be mounted substantially anywhere between the fixed end and the free end. The adjustment changes the stiffness with which the drum mount connects the drum leg or support to the drum.

11 Claims, 3 Drawing Sheets

DRUM MOUNT

FIELD OF INVENTION

This invention relates to the class of music. Specifically, this invention relates to the sub-classes of instruments, drums, and supports.

BACKGROUND OF INVENTION

Drums are the simplest, and most primitive, musical instruments. The drum is a percussive instrument, which produces sound by striking a membrane. The sound is propagated through a membrane, or drumhead, to the drum shell, which is designed to resonate when the membrane is struck. The drumhead is coupled to the drum shell through drum hoops, lugs, and lug or hoop holders. The energy created by striking the drum head is transferred into a wave in the drum shell, producing the distinctive drum sound, a tuned impulse.

While drums usually cannot play different pitches, they are usually tuned. The drum is tuned by tightening or loosening the drumhead by adjusting the lugs and drum hoops. The tighter the drumhead, the higher the pitch propagated by the drumhead.

Many drummers use a drum kit. Drum kits have several different drums, which can be individually tuned. A drum kit is often composed of various drums, such as a bass or kick drum, snare drums, and tom drums, as well as assorted cymbals and high-hats. When a drummer is drumming, there is substantial vibration throughout the drum kit. Additionally, the various drums can move or flex as they are struck, meaning that the drums, themselves, are vibrating and, therefore, moving. This is especially true of the tom and snare drums.

A drum mount or support is a sub-classification that includes many different methods of mounting the drum to legs or to other structural elements. The mounts used for drums often degrade the sound, because the drum is held too tightly, damping or attenuating the tuned impulse. Depending on how the drum mount is attached, and how it supports the drum, it can hinder the drum shell resonance, the drumhead, or both. Any drum mount or support that rigidly fixes itself to the drum, whether to the drum shell or the drum hoops, risks damping the sound. Some mounts attach to lugs or lug holders. This is a universally bad idea, because the lugs are supposed to be tuning the drum. By adding additional force to the lugs, such a support will change the tuning of the drum. Other mounts attach to the top and/or bottom hoops of the drum shell. Still other supports attach to the drum shell. Rigidly attached supports, whether mounted to the shell or hoops, will damp the vibration of the drum, and may, ultimately, distort the sound through buzzing or rattling, if the support mount is not properly engineered and attached.

As a result, a new device for mounting a drum is needed. The new mount should allow the drum shell to resonate freely. Such a mount needs to maintain the drum, in position, without, itself, generating objectionable sounds. The drum mount should be quickly and easily adjustable. It should also allow for quick set-up and break-down of a drum kit. A drum mount that has variable stiffness, and isolates the drum shell from the structural members supporting the drum would be ideal.

PRIOR ART REVIEW

There is clearly a market demand for a drum mount with variable stiffness that isolates the drum shell from the structural members supporting the drum. Many different patents have tried various approaches to this problem.

For example, some of the oldest prior art, U.S. Utility Pat. No. 624,662, by named inventor Leedy, entitled, "Drum stand" ("Leedy '662") teaches a drum stand that supports the bottom of the drum shell on three articulated members. Leedy '662 is a poor design, as it would rattle and make significant noise when used with a snare or tom drum. U.S. Utility Pat. No. 2,433,594, by named inventor Calo, entitled, "Drum stand" ("Calo '594") teaches a drum stand that supports the bottom of the drum shell and has articulating and adjustable balls to contact the shell and hold the drum in place. Calo '594 is a noisy solution, which is needlessly complex.

More recently, U.S. Utility Pat. No. 5,046,700, by named inventor Hoshino, entitled, "Drum mount for securing clamp" ("Hoshino '700") teaches a drum mount which has a fixed installation part and movable clamping part. The movable clamping part clamps to a drum leg or support, but it cannot be otherwise adjusted. Hoshino '700 teaches using a vibration damping seat integrated into the fixed installation part. Hoshino '700 is connected directly to the drum shell. Hoshino '700 is a popular solution, but it does not allow for an adjustment for how stiffly the drum is attached to the drum supports through the drum mount. U.S. Utility Pat. No. 5,645,253, by named inventor Hoshino, entitled, "Universal support for drum" ("Hoshino '253") teaches a semi-circular member that is bolted to the shell. The semi-circular member has a plurality of adjustable extension rods that can keep the semi-circular member under tension with respect to the drum shell. Hoshino '253 is complex and noisy. The multiple connections to the drum shell will buzz, while the mounting methodology is not easy to set-up nor easy to break apart. Moreover, Hoshino '253 will likely distort the shape of the drum shell over time.

U.S. Utility Pat. No. 8,168,873, by named inventor Okamoto, entitled, "Drum support structure" ("Okamoto '873") teaches a drum mount that has a wood base and attaches to the shell of the drum with a plurality of fasteners. The number of fasteners is related to the size of the drum shell. Okamoto '873 teaches rubber isolators or bushings that span the space between a mounting plate and the drum shell, and through which the plurality of fasteners extend. A drum leg or support member attaches to Okamoto '873 through a single screw or fastener. Okamoto '873 does not allow the effective mounting stiffness of the drum leg or support member to be adjusted. Also, a single fastener, between the drum leg or support and the mount is probably not as effective as it could otherwise be. U.S. Utility Pat. No. 4,158,980, by named inventor Gauger, entitled, "Mounting brackets for drums" ("Gauger '980") teaches a drum mount that has base connected to the drum shell. A through-hole in the base accepts a drum leg or support. The drum leg or support is held in place with a set-screw. Gauger '980 does not allow the effective mounting stiffness of the drum leg or support member to be adjusted, as the set-screw location is stationary with respect to the bracket. Also, a single set-screw, between the drum leg or support and the mount, is probably not as robust a solution as needed.

U.S. Utility Pat. No. 8,884,144, by named inventor Martin, entitled, "Drum mounting and tuning system providing unhindered and isolated resonance" ("Martin '144") teaches a complex drum mounting system using an upper and lower shell assembly (attached to the top and bottom of the shell), with complex dampers, to prevent unwanted vibration. Martin '144 is expensive, complex, and difficult to set-up and break-down. U.S. Utility Pat. No. 8,629,340, also by named inventor Martin, entitled, "Drum mounting and tuning system providing unhindered and isolated resonance" ("Martin '340") teaches a complex drum mounting system using an upper and lower shell assembly (attached to the top and bottom of the shell), with complex dampers, to prevent unwanted vibration. Martin '340 is expensive, complex, and difficult to set-up and break-down. U.S. Utility Pat. No. 9,293,122, also by named inventor Martin, entitled, "Drum mount providing isolated resonance" ("Martin '122") teaches a semi-circular bracket, with a plurality of friction-fit supports that terminate in a damper. Martin '122 is likely expensive, complex, and difficult to set-up and break-down. Additionally, Martin '122 appears like it could distort the drum shell over time if the plurality of friction-fit supports are not all exerting the same force on the shell.

U.S. Utility Pat. No. 8,927,841, by named inventor Hallerberg, entitled, "Drum stand stabilizing assembly" ("Hallerberg '841") teaches a drum stand that has a plate held in place by the drum tensioner rods. The plate is fitted with a slideable receiver for receiving a stand member. Hallerberg '841 likely rattles. Hallerberg '841 is also more complex, and therefore, costly, than it likely needs to be.

Substantial amounts of additional prior art exist teaching variations of drum mounts, but they are merely cumulative. The currently available solutions all have the same list of drawbacks: they are some combination of costly, complex, noisy, difficult to set-up and/or difficult to break-down. The market is still searching for a drum mount that is cost-effective, simple, quiet, and easy to set-up and break-down.

SUMMARY OF THE INVENTION

This summary is intended to disclose the present invention, a drum mount. The embodiments and descriptions are used to illustrate the invention and its utility, and are not intended to limit the invention or its use. The present invention, a drum mount, has two essential pieces: a fixed component and at least one mounting component. Both the fixed component and the mounting component can be, themselves, composed of multiple individual pieces or sub-components. In one embodiment ("first embodiment"), the fixed component is a U-bracket and the mounting component is comprised of the following sub-components: a screw plate, a U-bracket, a receiver hub, and a connecting member.

The fixed component is durably attached to the drum shell with fasteners. The fixed component has a planar, extending member, which connects with the mounting component(s). The planar, extending member has one end, attached continuously to the bulk of the fixed component, called the fixed end. The planar, extending member has another end, disposed opposed to the fixed end, called the free end, which can vibrate. The mounting components can be mounted substantially anywhere between the fixed end and the free end. The closer the mounting component(s) are mounted to the fixed end, the relatively stiffer the mounting system. The closer the mounting component(s) are mounted to the free end, the relatively less stiff the mounting system.

In the first embodiment, the screw plate is a flat, planar member with two holes in it. The U-bracket is a planar member bent into a "U." The U-bracket has a front planar member connected to a rear planar member with a curved section. The U-bracket has an inner surface and an outer surface. The front planar member has an inner and outer surface; the rear planar member has an inner and outer surface. The front planar member has two elongated slots. The rear planar member has two holes or slots. One end of the front planar member, referred to as the fixed end, is connected to the curved section of the U-bracket. The end of the front planar member opposite the fixed end is the free end. The U-bracket has a restoring force when deflected.

The receiver hub has a front surface and a rear surface. The rear surface of the receiver hub is flat. Running longitudinally down the front surface of the receiver hub is a channel. On each side of the channel is a raised plateau, centered on the long-axis of the front surface of the receiver hub. On each side of the channel are two holes. One hole on each side is centered on the raised plateau. On the left side of the receiver hub, the second hole is below the raised plateau. On the right side of the receiver hub, the second hole is above the raised plateau. The receiver hub is made from homogeneous material. The centroid of the receiver hub is roughly the geometric center of the receiver hub.

The connecting member has a substantially rectangular base, with a front surface and a rear surface. On the rear surface of the connecting member rectangular base, there is a channel parallel to the short sides of the rectangular surface that is centered on the rear surface. There are two holes through the connecting member, positioned on either side of the channel The receiver hub is connected to the U-bracket with two threaded fasteners. The threaded fasteners from the receiver hub pass through the elongated slots in the U-bracket, fastening to the screw plate. The connecting member fastens to the receiver hub with two additional threaded fasteners. In one embodiment, the connecting member has a bolt fastener that mates with a threaded screw post through the receiver hub, and a wing nut that mates with a second threaded screw post through the receiver hub. A drum leg or support can be securely captured and retained between the connecting member and receiver hub. The relative position of the support, such as a drum leg, can be adjusted by moving the receiver hub relative to the U-bracket. In this way, the stiffness of the support mounting system can be easily adjusted. Additionally, the user can select the appropriate position for their particular style, adjusting the drum mount to get the preferred amount of stiffness. When the receiver hub is positioned near the fixed end of the U-bracket, the mounting system will be relatively more stiff. When the receiver hub is positioned near the free end of the U-bracket, the mounting system will be relatively less stiff.

The drum mount components can be fabricated from stiff, environmentally durable materials such as poly(methylmethacrylate) ("PMMA" or tradenames Plexiglass or Lucite®), polycarbonate ("PC" or tradename Lexan®), acrylonitrile butadiene styrene ("ABS"), polypropylene ("PP"), high-density polyethylene ("HDPE"), low-density polyethylene ("LDPE"), wood, zinc, steel, or aluminum. The drum mount components can be fabricated from steel, which can be punched or forged. The drum mount components can also be fabricated from appropriate polymers, using standard manufacturing processes, such as injection molding. In the first embodiment, the U-bracket is fabricated from spring steel, while the connecting member and receiver hub are cast from zinc.

BRIEF DESCRIPTION OF THE DRAWINGS

The present invention is illustrated with 5 drawings on 3 sheets.

DETAILED DESCRIPTION OF THE DRAWINGS

The following descriptions are not meant to limit the invention, but rather to add to the summary of invention, and illustrate the present invention, a drum mount. The present invention is illustrated with a variety of drawings showing various possible embodiments.

Figure 1:
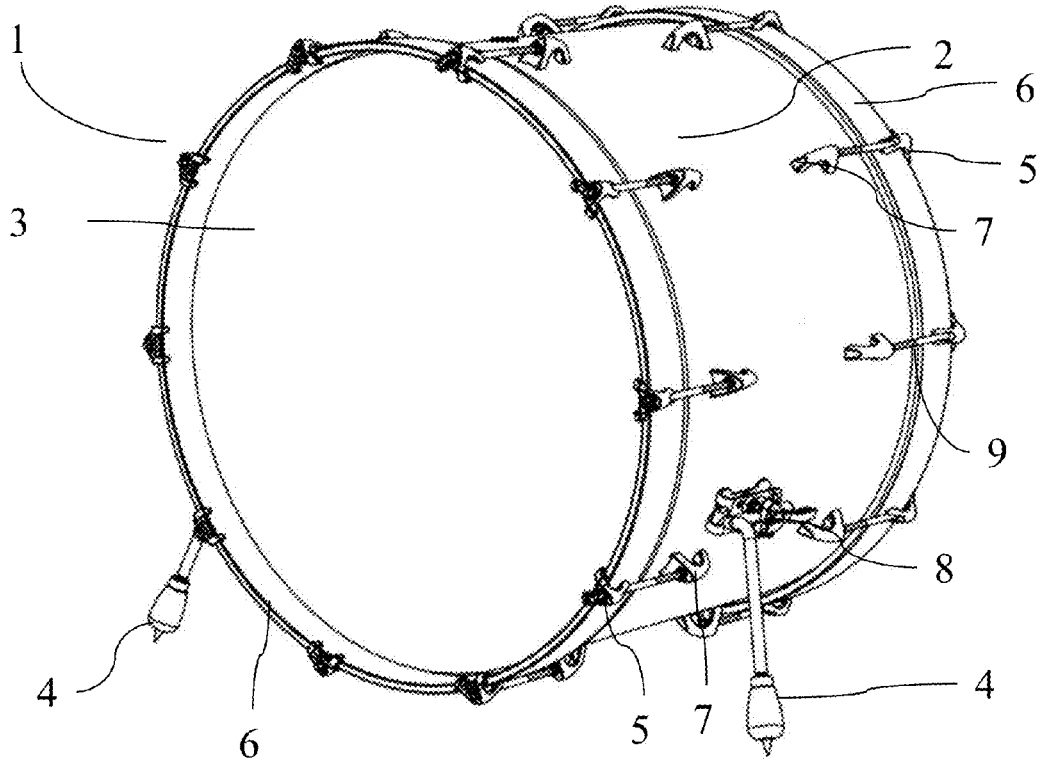
FIG. 1 is an isometric drawing of the present invention installed on a kick drum.

The present invention, a drum mount, has two essential pieces: a fixed component and at least one mounting component. Both the fixed component and the mounting component(s) can be, themselves, composed of multiple individual pieces or sub-components. The present invention is exemplified with drawings detailing the first embodiment. FIG. 1 shows an isometric view of the present invention, a drum mount 8, installed on kick drum 1. The kick drum 1 has a membrane 3 and shell 2. The membrane 3 is attached to the shell with a hoop 6. The hoop 6 is held on the shell 2 by tensioners 5, 7, 9. The visible components of the tensioner are the hoop retainer 5, lug 7, and tension rod 9. The tensioner 5, 7, 9 acoustically couples the membrane 3 to the shell 6, while it creates surface tension in the membrane 3. In this embodiment, a plurality of drum legs 4 are attached to the kick drum with the drum mount 8.

Figure 2:
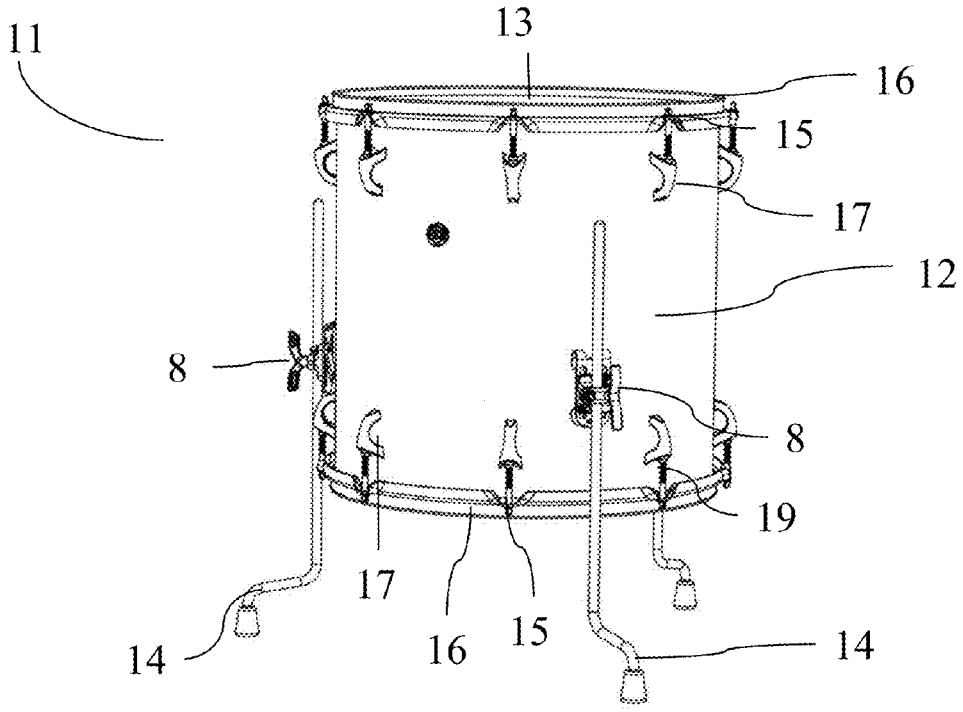
FIG. 2 is a side view of the present invention installed on a tom drum.

FIG. 2 shows an isometric view of the present invention, a drum mount 8, installed on tom drum 11. The tom drum 11 has a membrane 13 and shell 12. The membrane 13 is attached to the shell with a hoop 16. The hoop 16 is held on the shell 12 by tensioners 15, 17, 19. The visible components of the tensioner are the hoop retainer 15, lug 17, and tension rod 19. The tensioner 15, 17, 19 acoustically couples the membrane 13 to the shell 16, while it creates surface tension in the membrane 13. In this embodiment, a plurality of drum legs 14 are attached to the kick drum with the drum mount 8.

Figure 3:
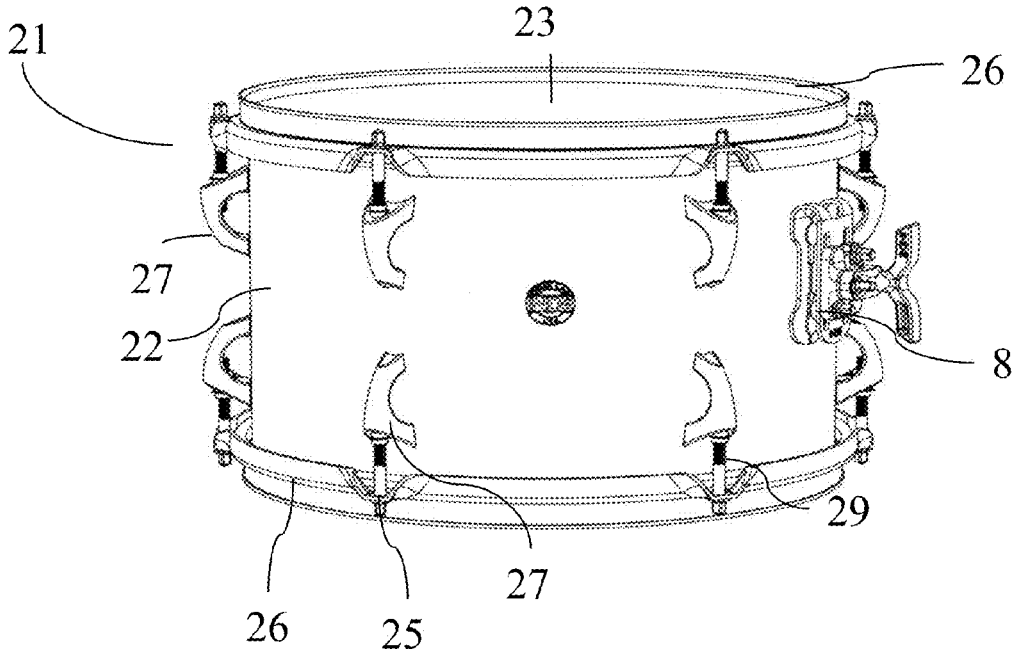
FIG. 3 is a side view of the present invention installed on a snare drum.

FIG. 3 shows an isometric view of the present invention, a drum mount 8, installed on snare drum 21. The snare drum 21 has a membrane 23 and shell 22. The membrane 23 is attached to the shell with a hoop 26. The hoop 26 is held on the shell 22 by tensioners 25, 27, 29. The visible components of the tensioner are the hoop retainer 25, lug 27, and tension rod 29. The tensioner 25, 27, 29 acoustically couples the membrane 23 to the shell 26, while it creates surface tension in the membrane 23. In this embodiment, the drum mount 8 is in situ on the shell 26, but no supports or legs are attached.

Figure 4:
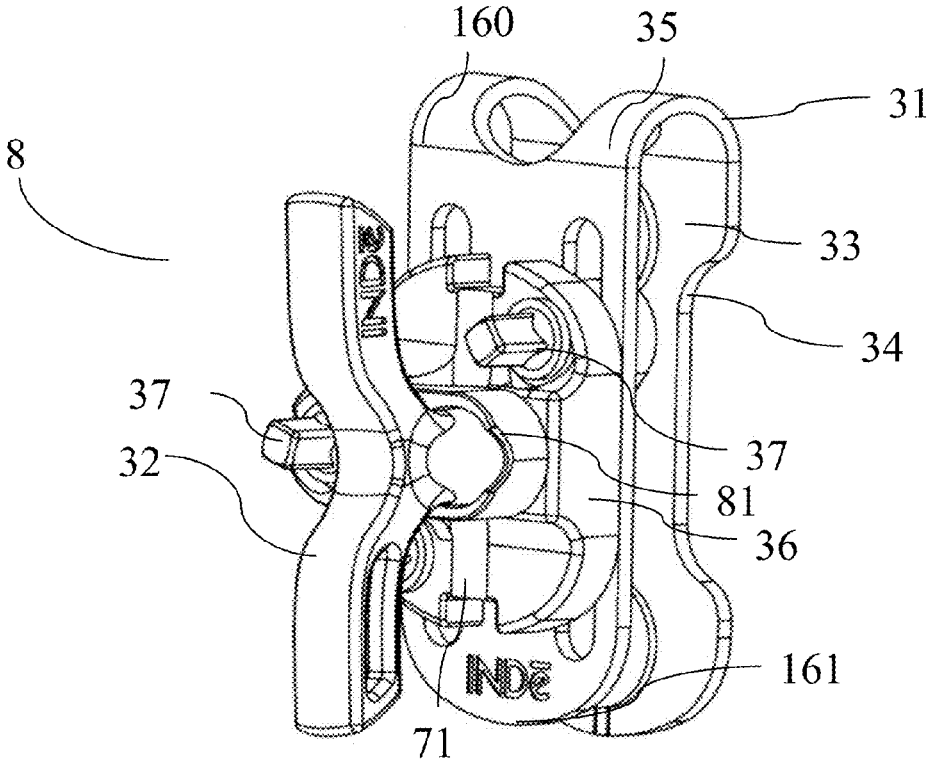
FIG. 4 is an isolated isometric view of the present invention.

The drum mount 8 is installed on the shell 2, 12, 22 of the drum 1, 11, 21. The drum mount 8 does not place the shell 2, 12, 22 under any type of stress, and does not create any von mises stress within the shell 2, 12, 22. At least one drum leg 4, 14, or other drum support, can be attached to the drum 1, 11, 21, with two threaded fasteners 37 (FIG. 4). Two threaded fasteners 37 also allow the drum mount 8 to be adjusted.

Figure 5:
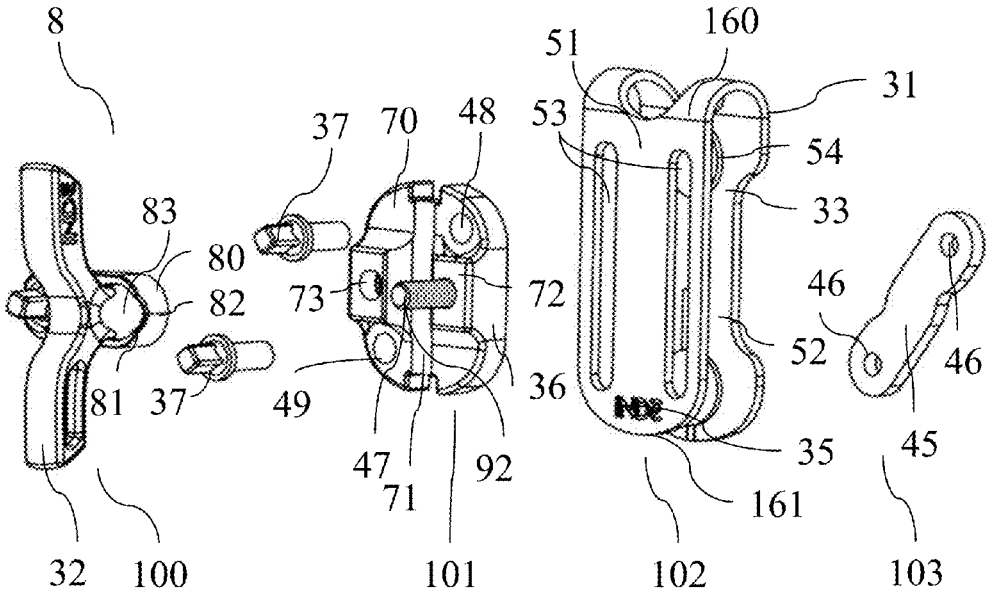
FIG. 5 is an exploded view of the present invention.

FIG. 4 shows an isolated isometric view of the drum mount 8; FIG. 5 shows an exploded view of the drum mount 8. The drum mount 8 is composed of a screw plate 103, a U-bracket 102, a receiver hub 101, a connecting member 100, and a plurality of fasteners 37, 92. The screw plate 103 has a flat, planar surface 45 with two holes 46 in it.

The U-bracket 102 has an outer planar surface 35 and an inner planar surface 33. The U-bracket 102 has a distinct front plane 51 and rear plane 52, connected by a curved portion 31. The U-bracket has a narrow edge 34, defining its thickness. On the front plane 51, there are two elongated slots 53. On the rear plane 52, there are two screw holes or slots 54. The front plane 51 is extended from the curved portion 31. The front plane 51 has a fixed end 160, where it connects to the curved portion 31. The front plane 51 also has a free end 161, which is opposite the fixed end 160.

The receiver hub 101 has a base 36 with a front surface 70 and a rear surface (not visible). The rear surface of the receiver hub is flat. Running longitudinally down the front surface 70 of the receiver hub is a channel 71, which partially bisects the base 36 of the receiver hub 101. On each side of the channel 71 is a raised plateau 72, centered on the longer dimension of the front surface 70 of the receiver hub 101. On each side of the channel are two holes 48, 49, 73. One hole 73 on each side is centered on the raised plateau 72. On the left side of the receiver hub 101, the second hole 49 is below the raised plateau 72. On the right side of the receiver hub 101, the second hole 48 is above the raised plateau 72. As with any physical part constructed from a homogeneous material, the receiver hub 101 has a centroid, which, due to the symmetry of the part, roughly corresponds to the geometric center of the receiver hub 101.

The connecting member 100 has a rounded rectangular base 80, with a front surface 81 and a rear surface (not shown). On the rear surface of the connecting member base 80, there is a channel parallel to the short side or edge 82 of the base 80 that is centered on the rear surface. There are two holes 83 through the connecting member 100, positioned on either side of the base 80. In one embodiment, the connecting member 100 attaches to the receiver hub 101 with a wing nut 32 and a standard bolt 37 disposed on the front surface 81 wherein a screw post 92 extends through the two holes 83. The standard bolt 37 can remain fixed, and the wing nut 32 can be loosened, releasing the support member or leg that is retained in the channel 71.

The receiver hub 101 is connected to the U-bracket 102 with two fasteners 37. In one embodiment, the fasteners 37 from the receiver hub 101 pass through the elongated slots 53 in the U-bracket 102, fastening to the screw plate 103. The connecting member 100 fastens to the receiver hub 101 with two additional fasteners 37, 92. At least one drum leg 4, 14 or support can be securely captured and retained between the connecting member 100 and receiver hub 101. The position of the support, such as a drum leg 4, 14 can be adjusted by moving the receiver hub 101 relative to the U-bracket 102, by adjusting the fasteners 37 in the screw holes 48, 49 connecting the receiver hub 102 to the screw plate 103. In this way, the stiffness of the support and mount system can be easily adjusted. Additionally, the user can select the appropriate position for their particular style, adjusting the drum mount 8 to get the preferred amount of stiffness.

The drum mount 8 components 100, 101, 102, 103 can be fabricated from stiff, environmentally durable materials such as poly(methyl-methacrylate) ("PMMA" or tradenames Plexiglass or Lucite®), polycarbonate ("PC" or tradename Lexan®), acrylonitrile butadiene styrene ("ABS"), polypropylene ("PP"), high-density polyethylene ("HDPE"), low-density polyethylene ("LDPE"), wood, zinc, steel, or aluminum. The drum mount 8 components 100, 101, 102, 103 can be fabricated from steel, which can be punched (stamped) and/or forged (hot or cold). The drum mount 8 components 100, 101, 102, 103 can also be fabricated from appropriate polymers, using standard manufacturing processes, such as injection molding. In the first embodiment, the U-bracket 102 is fabricated from spring steel, while the connecting member 100 and receiver hub 101 are cast from zinc.

I claim:

1. A drum mount comprising a fixed component and at least one mounting component, wherein the fixed component is attached to a drum shell with at least one threaded fastener;

the fixed component has a planar extending member with at least two ends, one a fixed end and one a free end;

at the fixed end, the extending member is fixed relative to the drum shell; and at the free end, the extending member is free to vibrate, orthogonally, relative to the drum shell;

wherein the mounting component can be fastened to the planar extending member; and wherein the mounting component can be fastened to the planar extending member of the fixed component substantially anywhere along the length of the planar extending member from the fixed end to the free end.

2. The drum mount of claim 1, wherein the fixed component ("U-bracket") is fabricated from a continuous piece of material, having two planar members opposed to one another and connected with a curvilinear surface, and the mounting component is comprised of a substantially planar screw plate having two holes; a receiver hub; and a connecting member.

3. The drum mount of claim 2, wherein one of the planar members of the U-bracket ("rear plane"), having two slotted holes, attaches to a drum body with fasteners;

the other planar member of the U-bracket ("front plane"), having two elongated slots, attaches to the connecting member, screw plate, and receiver hub with fasteners, the front plane, having a rectangular shape with two long linear edges and a short, rounded edge ("free-end"), attaches to the curvilinear surface at the fixed end, wherein the free-end is distal to the fixed end; two elongated slots in the front plane and two holes or slots in the rear plane;

the receiver hub is fabricated as a single sub-component from a single material, having a substantially rectangular base, with two long edges and two short edges, a front surface with a raised plateau, a flat rear surface, and four (4) holes extending from the front surface to the rear surface, the front surface having a channel partially bisecting the front surface of the base, including the raised plateau, said channel running parallel to the long edges of the substantially rectangular base;

the connecting member fabricated as a single sub-component having a base that has a channel partially bisecting the rear surface of the base, between the two holes;

wherein the receiver hub attaches to the front plane of the U-bracket with fasteners extending through the receiver hub and the elongated slots of the front plane of the U-bracket, to connect with the screw plate, and the connecting member, thereby capturing and securing a tubular drum support between the defined channels of the rear surface of the connecting member and the front surface of the receiver hub.

4. The drum mount of claim 3, wherein the U-bracket, receiver hub, connecting member, and screw plate are fabricated from one of wood, zinc, steel, aluminum, poly (methyl-methacrylate) ("PMMA"), polycarbonate ("PC"), acrylonitrile butadiene styrene ("ABS"), polypropylene ("PP"), high-density polyethylene ("HDPE"), and low-density polyethylene ("LDPE").

5. The drum mount of claim 3, wherein the U-bracket is fabricated from spring steel.

6. The drum mount of claim 3, wherein the receiver hub and connecting member are fabricated from cast zinc.

7. The drum mount of claim 3, wherein one hole is placed on the left side of the receiver hub, below the plateau, and another hole is placed on the right side of the receiver hub, above the plateau.

8. The drum mount of claim 7, wherein a mounting location of the receiver hub with respect to the U-bracket can be defined as a relative position; and wherein the relative position of the receiver hub with respect to the U-bracket can be varied without disconnecting the connecting member from the receiver hub, or removing the tubular drum support from between the receiver hub and connecting member, by adjusting the fasteners that connect the receiver hub to the screw plate.

9. The drum mount of claim 8, wherein the receiver hub has a center of mass and a linear displacement of the receiver hub center of mass with respect to the fixed end of the U-bracket can be defined by a distance;

wherein the stiffness with which the mount connects the tubular drum support to the drum is inversely proportional to the distance between the center of mass of the receiver hub and the fixed end of the U-bracket.

10. The drum mount of claim 3, wherein the connecting member can be tightened with respect to the receiver hub by tightening at least one wing-nut.

11. The drum mount of claim 10, wherein the tubular drum support can be removed by loosening one wing-nut that connects the connecting member to the receiver hub.

* * * * *